US005086875A

United States Patent [19]

Shreve, III

[11] Patent Number: 5,086,875

[45] Date of Patent: Feb. 11, 1992

[54] FOLDING SCAFFOLD

[76] Inventor: Arthur L. Shreve, III, P. O. Box 25, Butler, Md. 21023

[21] Appl. No.: 606,434

[22] Filed: Oct. 31, 1990

[51] Int. Cl.[5] ..... E04G 1/34

[52] U.S. Cl. ..... 182/152; 182/119

[58] Field of Search ..... 182/152, 178, 179, 153, 182/119

[56] References Cited

U.S. PATENT DOCUMENTS

| | | | |
|---|---|---|---|
| 2,177,153 | 10/1939 | Ross | 182/152 |
| 2,599,670 | 6/1952 | Thomas | 182/152 |
| 2,619,390 | 11/1952 | Johnson | 304/3 |
| 2,782,075 | 2/1957 | Fagan | 304/2 |
| 2,852,145 | 9/1958 | Scholz | 211/178 |
| 2,900,158 | 8/1959 | Ditter | 248/166 |
| 2,925,921 | 2/1960 | DePew | 211/148 |
| 3,207,260 | 9/1965 | Castagna | 182/152 |
| 3,493,208 | 2/1970 | Sato | 248/235 |
| 3,616,469 | 11/1971 | Injeski | 5/331 |
| 4,428,458 | 1/1984 | Fiore | 182/116 |
| 4,534,447 | 8/1985 | Champigny | 182/152 |
| 4,609,071 | 9/1985 | Edwards | 182/152 |
| 4,883,147 | 11/1989 | Davidson | 182/152 |

*Primary Examiner*—Reinaldo P. Machado

[57] ABSTRACT

A folding scaffold for supporting workers and material including a folding frame and a plurality of supporting planks. The frame includes two ladder frames with rungs, which ladder frames are connected by the support frames which hold the ladder frames a spaced distance apart when the scaffold is fully extended. The support frames are of different size and they are hingedly connected to fit in the same plane when the scaffold is in the folded position. The larger support frame protrudes a spaced distance from the smaller support frame when in the same plane to form a handle for easy transport of the scaffold when folded. When fully extended the end of the larger support frame is equi-distant from the ladder frames. The supporting planks extend between the ladder frame and are notched to receive the rungs of the ladder frame to hold the ladder frames in a parallel relation. A removable snap-on spring clip retains the ladder frames in the folded position for transport or storage.

3 Claims, 10 Drawing Sheets

FOLDING SCAFFOLD

BACKGROUND OF THE INVENTION

1. Field Of the Invention:

The invention relates to an improved folding scaffold.

2. Related Art:

Scaffold devices are used in various forms to support workers and materials during the construction and remodeling of buildings specifically and for other purposes generally. The main use of such devices being depicted for use on construction sites to support workers and materials at various locations about a structure. See U.S. Pat. Nos. 2,619,390, 4,534,447, and 4,609,071. Some scaffolds are collapsible for transportation and storage. See U.S. Pat. Nos. 4,534,447 and 4,609,071. Typically, these devices comprise a pair of support ladders attached by tubular frames hinged in some fashion equi-distant from the support ladders. See U.S. Pat. Nos. 4,523,447 and 4,609,071. Support planks or boards extend across the corresponding rungs of the ladders and are used to rigidly maintain the ladders in a parallel relation to each other and to support the workers and materials. See the board retaining mechanisms in U.S. Pat. Nos. 2,619,390 and 4,534,447. In addition, the hinged tubular frames are sometimes held in the open or fully extended position with U-shaped channel members as in U.S. Pat. No. 4,534,447 or movement of the tubular frames is restricted with the use of a window formed in a sleeve on one end of a frame and a locking projection mounted in the other frame end as in U.S. Pat. No. 4,609,071.

The folding devices collapse to a thickness of four tubular diameters and must be transported by rolling on casters as in U.S. Pat. No. 4,534,447 or hand carried as in U.S. Pat. No. 4,609,071. Hand carrying creates an awkward situation to a workmen in attempting to carry a folded scaffold having no convenient grip or handle and having no method of preventing the scaffold from unfolding. The boards or planks must be carried separately from the scaffold requiring either more than one trip or the efforts of more than one person. In addition, the thickness of the device in the folded position requires more storage or transport space than one that could be folded to a three diameter thickness.

SUMMARY AND OBJECTS OF THE INVENTION

In view of the above described problems, it is an object of this invention to provide an improved folding scaffold which is easy to transport through the use of a convenient handle formed by the tubular frames when in the folded position and held in place with a clip over adjacent opposite vertical posts of the ladder frames. It is a further object of this invention to provide a folding scaffold which collapses to a thickness of only three tubular diameters for more compact storage. Another object of the invention is to provide a sturdy device which will not bend, twist, or otherwise deform when a worker uses the tubular frames to mount the platform.

The above objects of this invention are accomplished with the use of generally rectangular tubular frames of different sizes wherein the smaller frame fits into the same plane of the larger one. The hinge which connects the verticle ends of each support frame is formed by a rotatably mounted sleeve in the larger frame end, fixedly connected to and spaced away from the vertical end of the smaller frame. The sleeve on the larger frame is positioned equi-distant between the ladder frames when the scaffold is fully extended. A retaining clip fits over the opposite adjacent vertical posts of the ladder frames when the scaffold is folded and prevents unfolding during transport. In addition, the tubular support frames are supported on the ladder frames with the use of retaining collars to prevent distortion of the frames should a worker mount the scaffold using the frames instead of the rungs of the ladder frames. The planks are made from sturdy light-weight metal or other suitable material with notches or grooves to fit over and engage the ladder rungs to hold the ladder frames parallel to each other. The rungs of one ladder can have threaded studs protruding horizontally for mounting the planks on the folded scaffold for ease of transport and storage.

DETAILED DESCRIPTION OF THE PREFERRED EMBODIMENT

Figure 1:
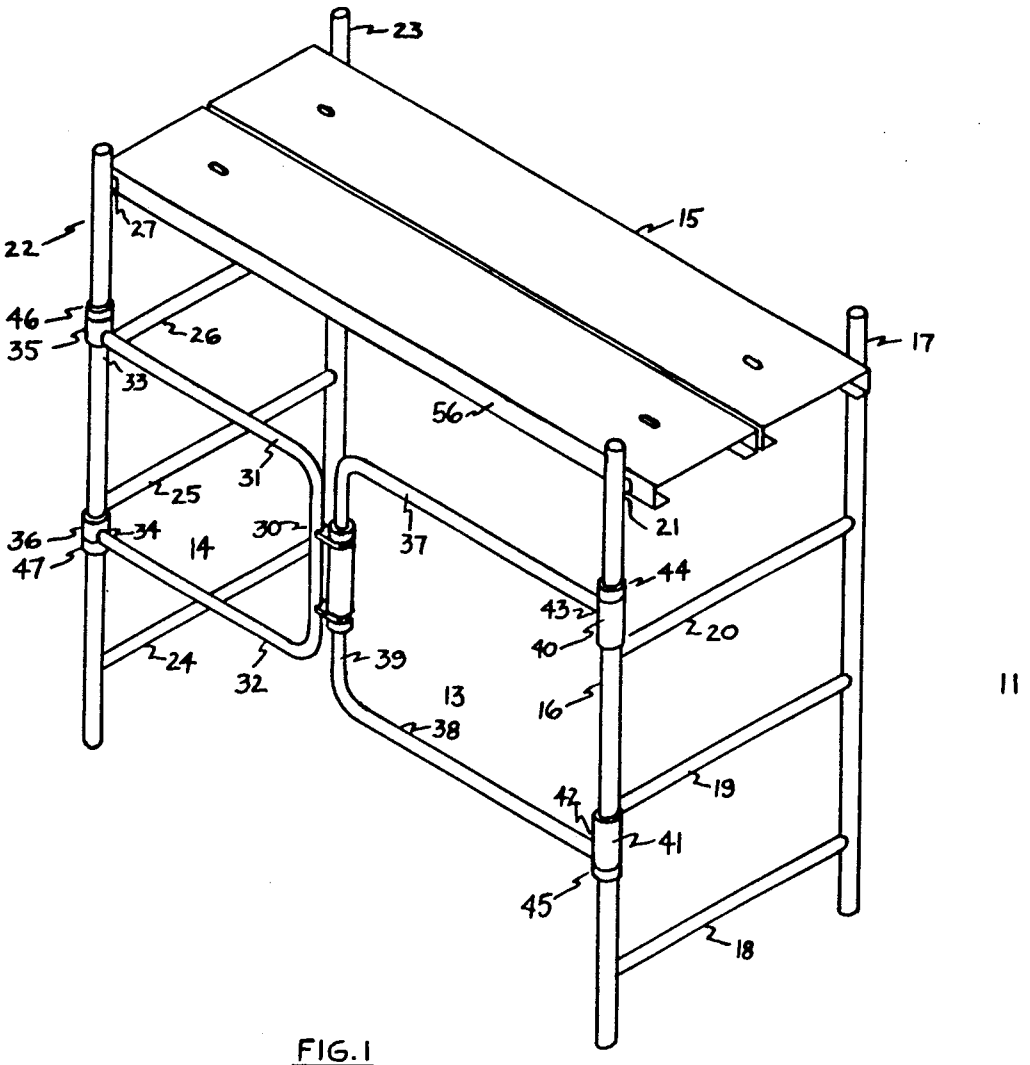
FIG. 1 is a perspective view of the preferred embodiment of the improved folding scaffold device of the present invention in the fully extended position.

FIG. 1 shows a folding scaffold generally indicated by the number 10 which is the preferred embodiment of the present invention. The scaffold 10, consists essentially of a first ladder frame 11 and a second ladder frame 12 both extending vertically and connected by a first tubular support frame 13, and a second tubular support frame 14. Ladder frame 11 has a pair of vertical tubular posts 16 (rear post) and 17 (front post) fixedly secured to four horizontally extending tubular members or rungs 18–21 to provide a rigid ladder frame. Similarly, ladder frame 12 has a pair of vertical posts 22 (rear post) and 23 (front post) fixedly secured to four horizontally extending tubular members or rungs 24–27 to provide a rigid ladder frame. Boards or planks 15 and 15A can be placed on top of and across corresponding rungs at any level of the first and second ladder frames to support workers and material. The rungs further provide steps to enable a worker to climb up to and down from the planks.

The tubular support frames 13 and 14 have vertical ends which are pivotally joined between the ladder frames 11 and 12. The support frames 13 and 14 have proximal ends pivotally mounted to the rear vertical posts 16 and 22 of ladder frames 11 and 12. Boards or planks 15 and 15A are positioned on top of any two of the aligned horizontal rungs (21 and 27, 20 and 26, or 19 and 25) of the ladder frames 11 and 12 to support workers and materials. Said boards or planks 15 and 15A include transverse notches or slots at each end thereof spaced apart the same distance as the aligned rungs of each ladder frame 11 and 12 to engage said rungs and maintain the ladder frames 11 and 12 in a parallel relation to each other.

Figure 2:
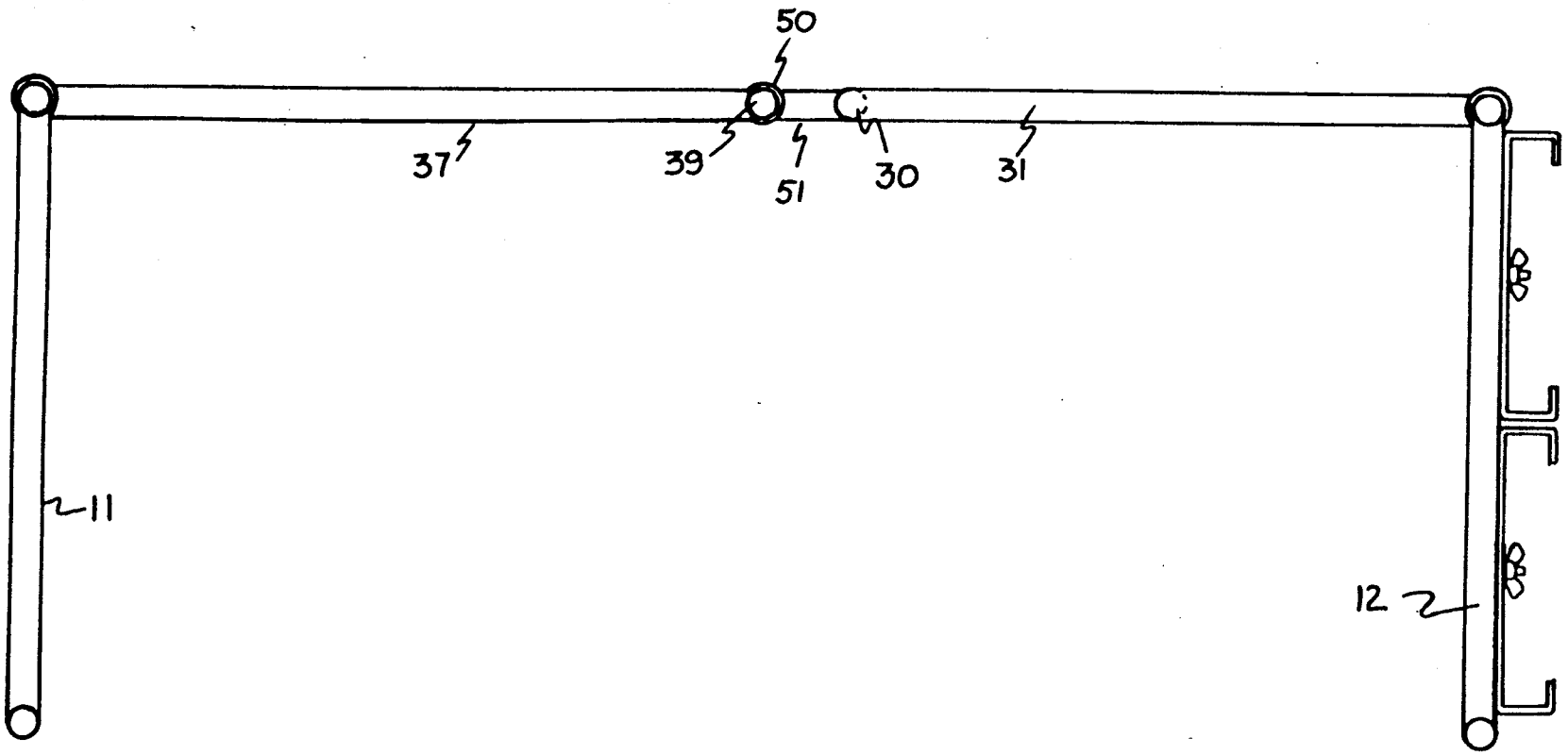
FIG. 2 is a detailed cross-sectional front view of the preferred embodiment in the fully extended position showing the generally rectangular shapes and sizes of the tubular support frames.

FIG. 2 shows the generally rectangular first tubular support frame 13 comprising a vertically extending distal end 39, a generally horizontally extending top portion 37 and a generally horizontally extending lower portion 38, which extend to their respective proximal ends 42 and 43. A pair of sleeve mounts 40 and 41 are respectively rotatably attached to ends 42 and 43 with the sleeves extending rotatably around post 16. Sleeve 40 rests upon the top of rung 20 of ladder frame 11 to prevent the downward movement of the top tubular member 37 of support frame 13. A retaining collar 44 is fixedly attached around post 16 and closely above sleeve 40 to prevent upward movement of the top tubular member 37 of support frame 13. Likewise, sleeve 41 is positioned under rung 18 of ladder frame 11 to prevent upward movement of the bottom tubular member 38 of support frame 13 and a retaining collar 45 is fixedly attached around post 16 and closely below sleeve 41 to prevent downward movement of the bottom tubular member 38 of support frame 13. FIG. 2 also shows the similar but smaller configuration of the support frame 14 comprising a vertically extending distal end 30, a generally horizontally extending top portion 31, and a generally horizontally extending bottom portion 32, which extend to their respective proximal ends 33 and 34. A pair of sleeves 35 and 36 are respectively rotatably attached to ends 33 and 34, with the sleeves extending rotatably around post 22 of ladder frame 12. Sleeve 35 rests upon the top of rung 26 to prevent the downward movement of the top tubular member 31 of support frame 14. A retaining collar 46 is fixedly attached around post 22 and closely above sleeve 35 to prevent upward movement of the top tubular member 31. Likewise, sleeve 36 is positioned closely under rung 24 of the ladder frame 12 to prevent upward movement of the bottom tubular member 32 and a retaining collar 47 is fixedly attached around post 22 and closely below the sleeve shaped mount 36 to prevent downward movement of the bottom tubular member 32.

Figure 3:
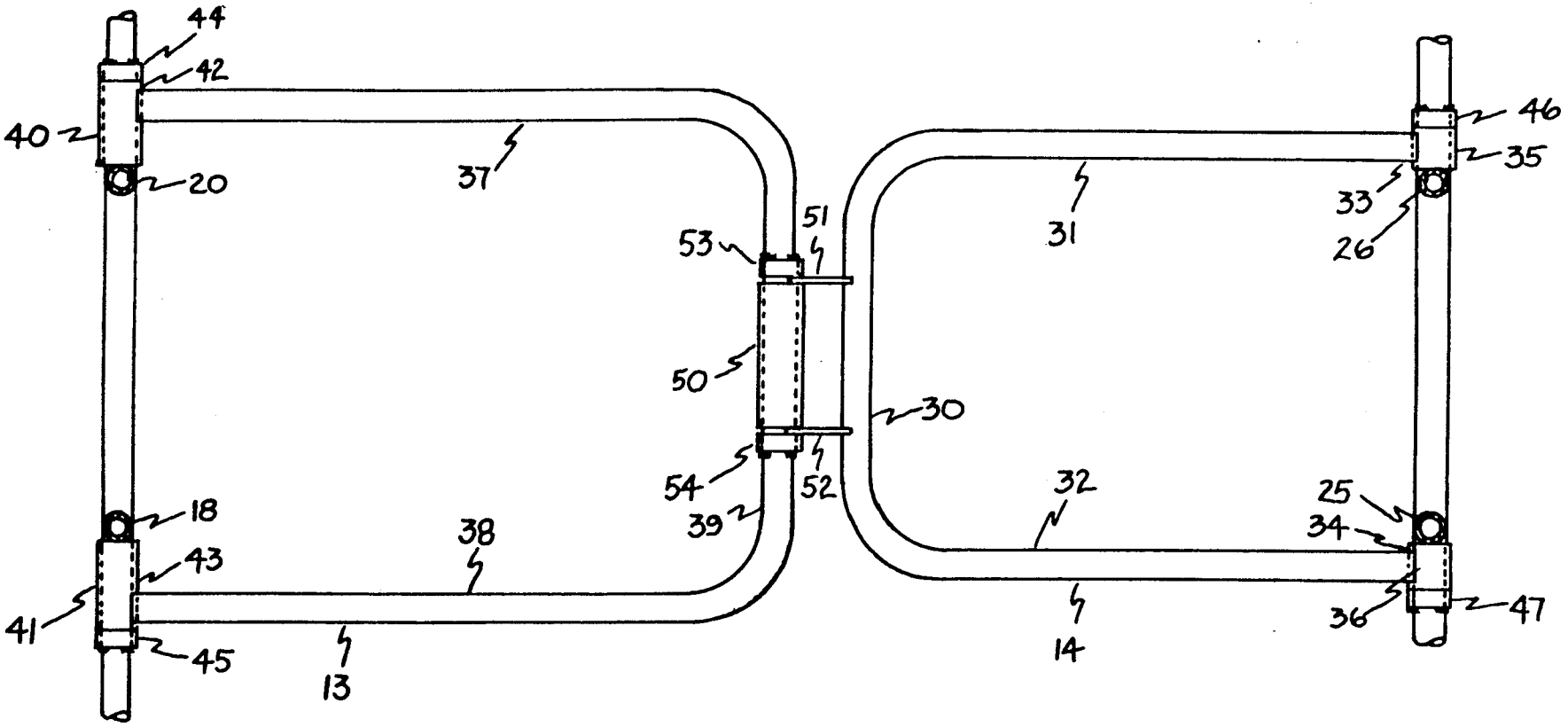
FIG. 3 is a detailed top view of the preferred embodiment in the fully extended position showing the sleeve of the hinge between the tubular support frames located equi-distant from the ladder frames.
Figure 4:
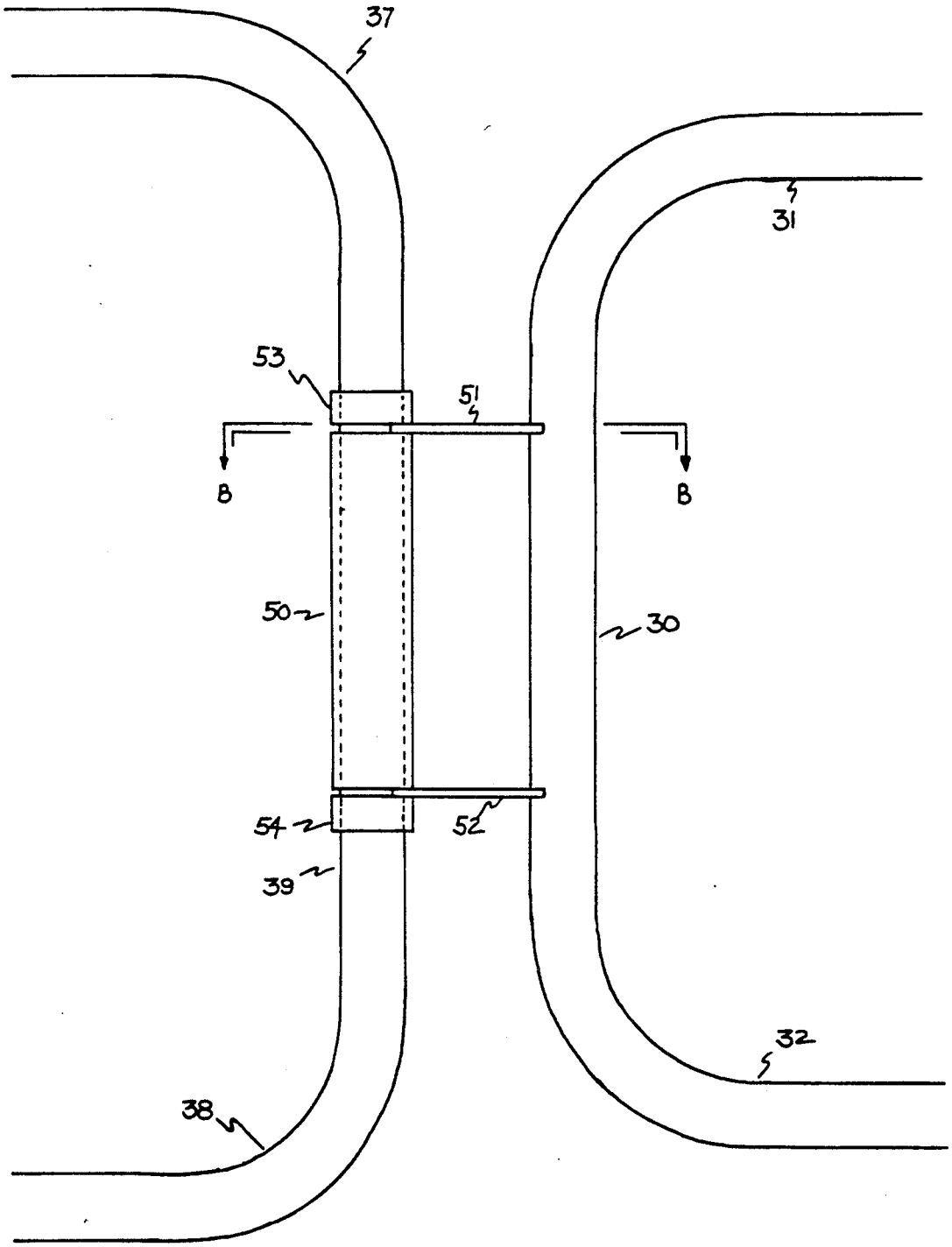
FIG. 4 is a partially exploded front view of the hinged area connecting the two generally rectangular tubular support frames in the fully extended position.

FIG. 2 also shows the distal vertical ends of the first and second support frames 13 and 14 hingedly connected by a hinge means comprising a sleeve 50 fully surrounding the verticle tubular distal end 39 of support frame 13, and two spacers 51 and 52 fixedly connecting sleeve 50 at a spaced distance from the tubular vertically extending end 30 of support frame 14. FIG. 3 shows the sleeve 50 surrounding the distal end 39 positioned equidistant between the ladder frames 11 and 12 when the scaffold is fully extended and FIG. 4 shows the hinge means both when the scaffold is fully extended.

Figure 5:
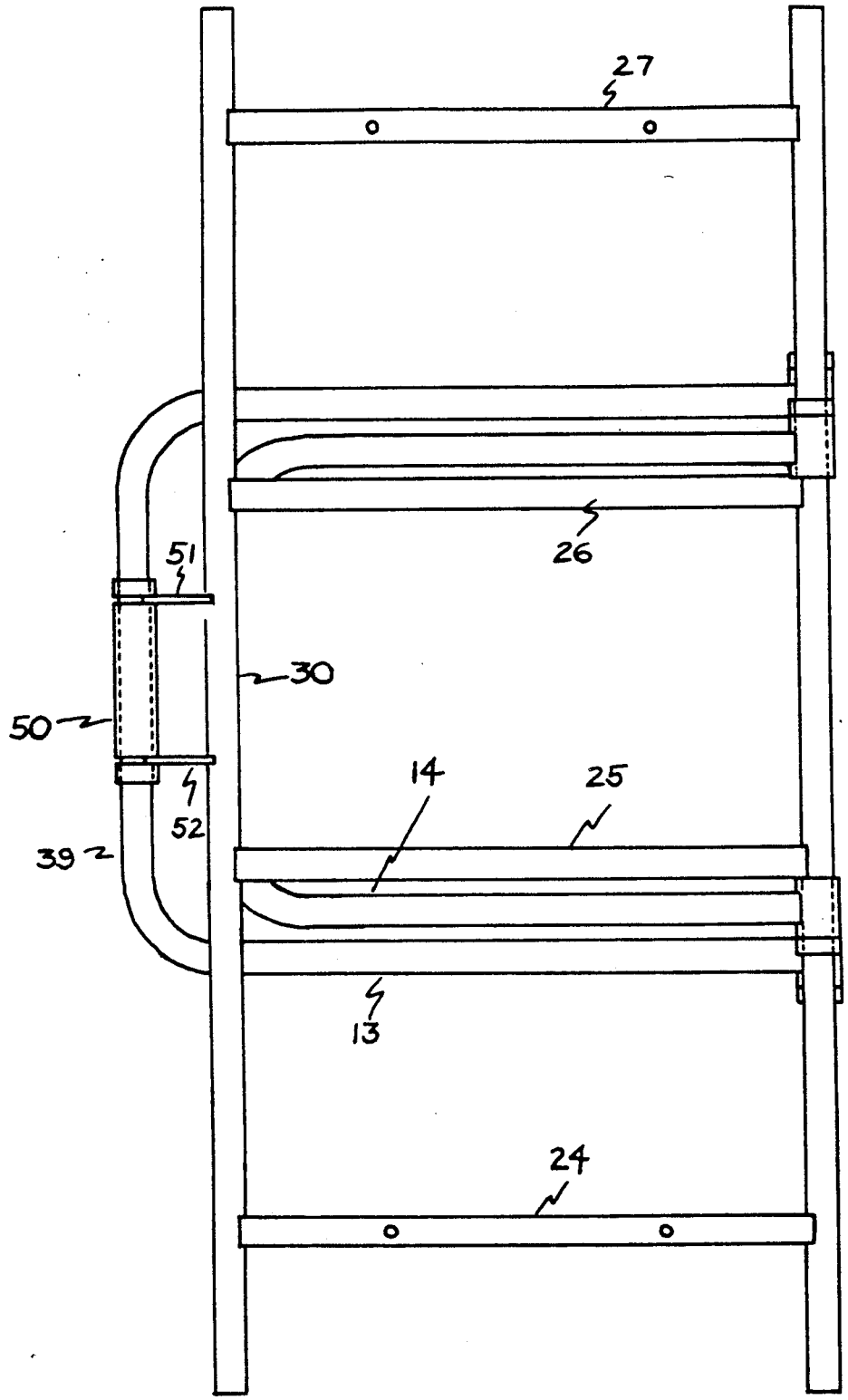
FIG. 5 is a detailed side view of the preferred embodiment in the folded position showing the formation of a handle from the positions of the smaller tubular support frame in the plane of the larger one.
Figure 6:
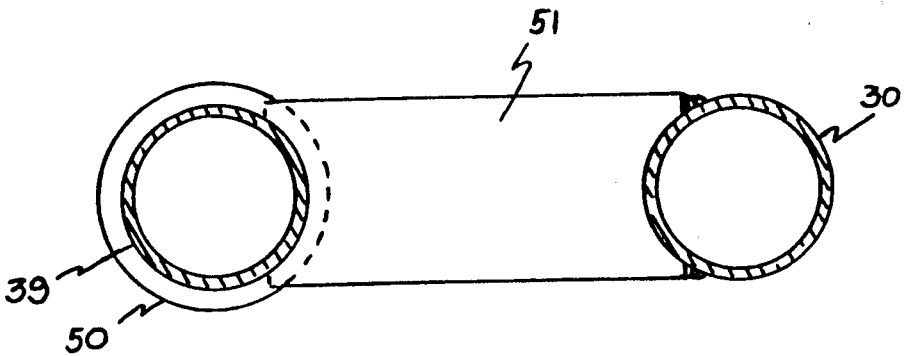
FIG. 6 is a partially exploded cross-sectional top view of the hinged area in section B-B of FIG. 4, connecting the two generally rectangular tubular support frames in the folded position.

When the scaffold 10 is folded by rotating the support frames 13 and 14 toward the front vertical posts 17 and 23 of ladder frames 11 and 12 respectively, support frame 14, being smaller than support frame 13, fits inside of and in the same plane with the larger support frame 13 as shown in FIG. 5. The sleeve 50 and the spacers 51 and 52 form a handle to carry the scaffold 10, in its collapsed configuration as shown in FIG. 5. The spacers are fixedly attached to the sleeve 50 and the tubular vertically extending end 30 as shown in FIG. 6. Because support frame 14 fits inside of and on the same plane with support frame 13, the thickness of the scaffold 10 in its folded position as shown in FIG. 7, is only three tubular diameters consisting of the diameters of the front vertical posts 17 and 23 of the ladder frames 11 and 12 respectively, and the vertically extending distal end 30 of support frame 13.

Figure 7:
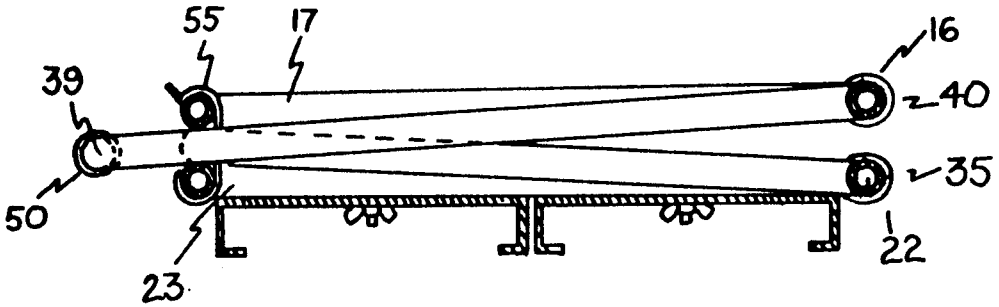
FIG. 7 is a detailed top view of the preferred embodiment in the folded position with the spring clip attached.
Figure 8:
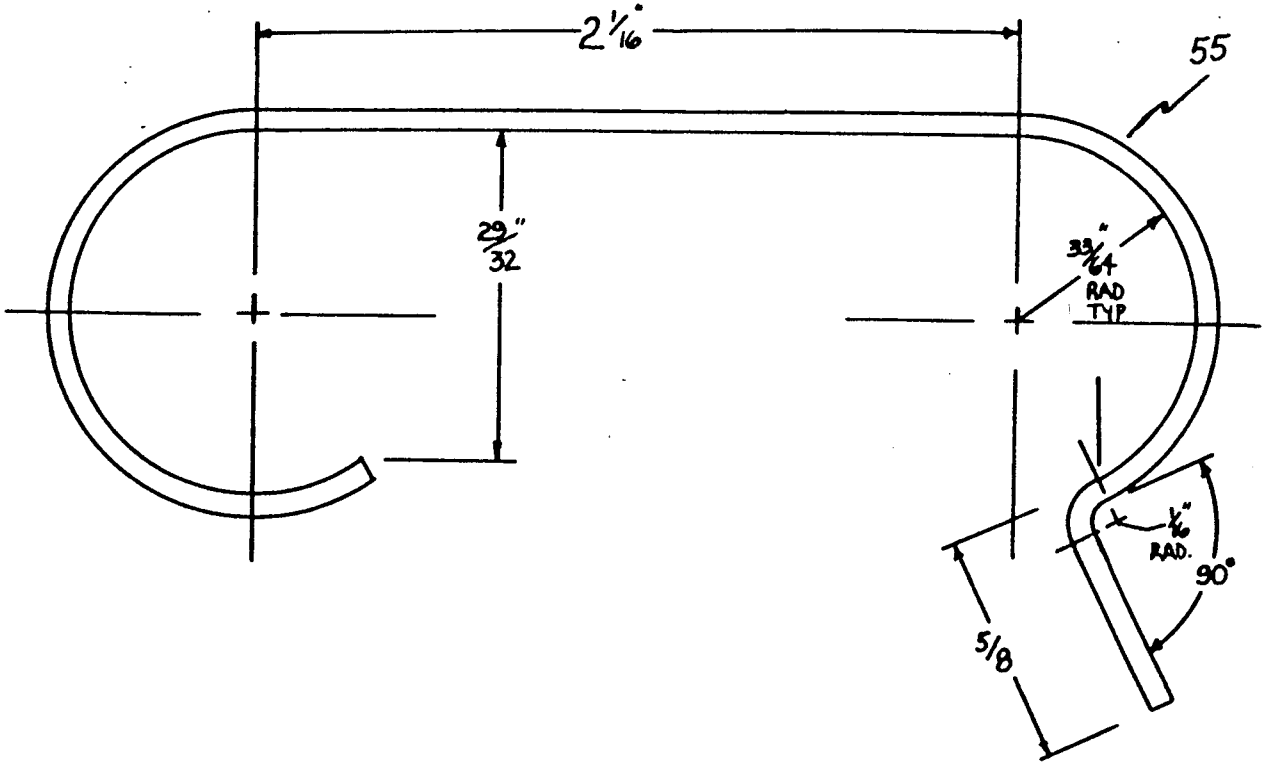
FIG. 8 is a plan view of the spring clip.

FIG. 7 also shows a retaining spring-clip 55 as shown in detail in FIG. 8, made of resilient spring-like material curved on each end to fittingly engage and simultaneously and substantially surround opposite adjacent front vertical posts 17 and 23 when the scaffold 10 is in the collapsed position to securely hold the ladder frames 11 and 12 substantially against the larger support member 13.

Figure 9:
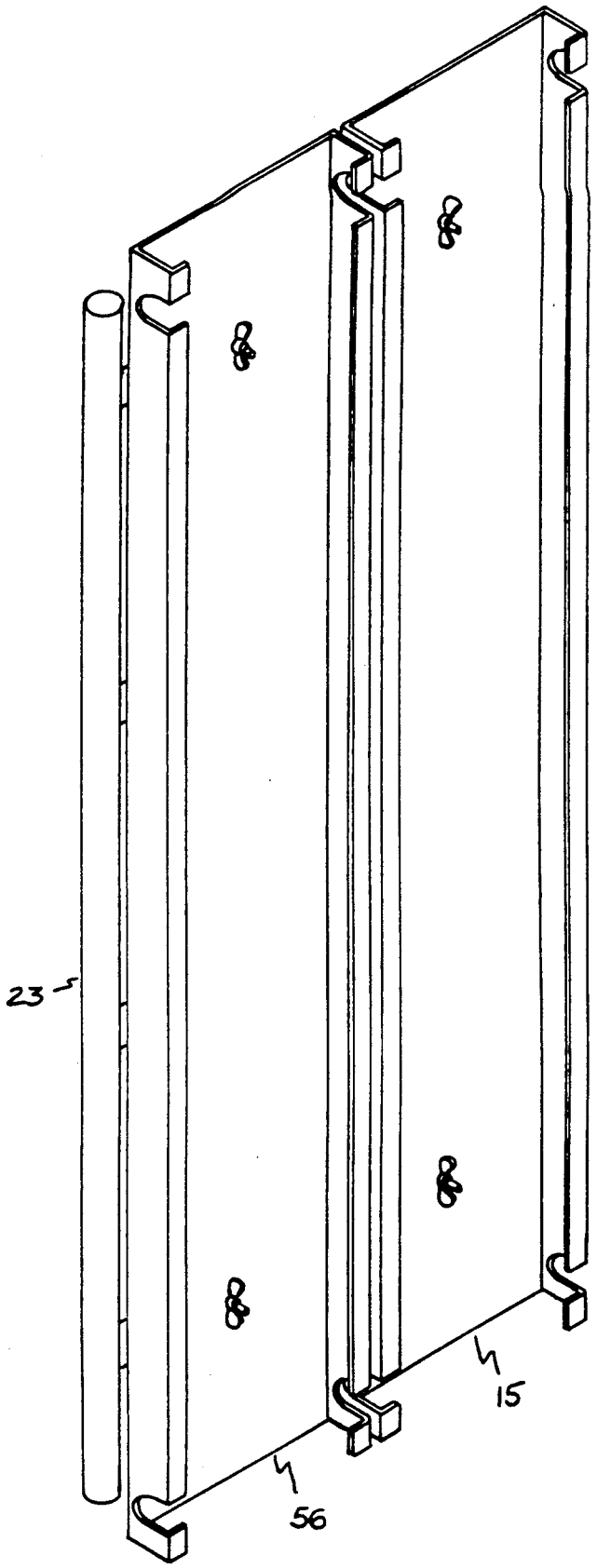
FIG. 9 is a perspective view of the planks attached to one of the ladder frames during transport.
Figure 10:
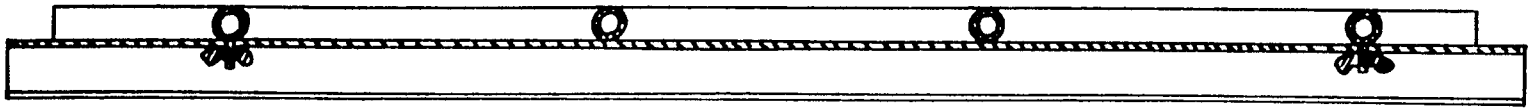
FIG. 10 is a cross-sectional side view of the planks attached as in FIG. 9.

FIGS. 9 and 10 show boards or planks 15 and 15A removably fastened to the rungs 24 and 27 of ladder member 12 by threaded studs 48 protruding horizontally and at 90° from said rungs. Wing-nuts 49 hold the planks 15 and 15A to the rungs. The planks are removed to be placed on the top of corresponding rungs of the ladder frames 11 and 12 as described before. FIG. 10 is a cross section side view of plank 15A attached to the rungs 24 and 27 of ladder frame 23 for transport and storage.

While one embodiment of the invention has been described, it will be understood that it is capable of further modification, and this application is intended to offer any variations, uses or adaptions of the invention, following, in general, the principles of the invention and including such departures from the present disclosures as to come within the knowledge or customary practice in the art to which this invention pertains, and as may be applied to the essential features hereinbefore set forth and falling within the scope of the invention or the limits of the appended claims.

I claim:

1. An improved folding scaffold device of the type which comprises:

a first ladder frame consisting essentially of a front vertical post and a rear vertical post and a plurality of horizontal rungs interconnecting said posts;

a second ladder frame consisting essentially of a front vertical post and a rear vertical post and a plurality of horizontal rungs interconnecting said posts;

a plurality of flat board shaped members positionable atop one of the rungs of the first ladder frame and atop one of the rungs of the second ladder frame and providing a supporting surface therontop;

the flat board shaped members including a transverse notch at each end to fittingly engage opposing horizontal rungs of the first ladder frame and the second ladder frame to rigidly maintain the ladder frames in a parallel relation to each other;

a first support frame including a first pair of aligned sleeve shaped proximal ends pivotally connected to the rear vertical post of the first ladder frame, said first support frame also including a first vertically extending distal end with the first support frame converging from the first proximal ends to the distal end;

a second support frame including a second pair of aligned sleeve shaped proximal ends pivotally connected to the rear vertical post of the second ladder frame, the second support frame also including a second vertically extending distal end positioned adjacent to the distal end of the first support frame, with the second support frame converging from the second pair of proximal ends to the distal end of the second support frame;

hinge means to pivotally connect together the distal end of the first support frame and the distal end of the second support frame for pivotal movement of the first support frame and the second support frame from a fully-extended position in which the support frames are in substantial end to end alignment and perpendicular to the first and second ladder frames, to a folded position, the pivotal movement of the first and second support frames producing relative lateral movement of the first and second ladder frames from a parallel spaced apart relation, one toward the other, to contiguous positions wherein the improvements comprise:

a. a second support frame smaller than the first support frame such that the smaller support frame fits within the plane of the first support frame when the scaffold is in the folded position and wherein the hinge means to pivotally connect the proximal ends of the support frames includes a pair of spacer members fixedly attached to a sleeve rotatably connected to the distal end of the second support frame a spaced distance therefrom and fixedly attached to the distal end of the first support frame to form a handle; to position the sleeve and the distal end of the second support frame equidistant from the first and second ladder frames when fully extended; and to position the front vertical posts of the ladder frames in close opposite relation to each other when the first and second ladder frames and the first and second support frames are in the folded position;

b. a fastening means for removably attaching the board shaped members to the rungs of the first and second ladder frames when the scaffold is in the folded position;

c. a first retaining means fixedly connected to the distal end of the first support frame limiting the vertical movement of the sleeve on the distal end of the first support frame;

d. a second retaining means connected to the front and rear vertical posts of the first and second ladder frames limiting the vertical movement of the sleeve shaped proximal ends of the first and second support frames;

e. a third retaining means removably attached to the front vertical posts of the first and second ladder frames to secure the first and second ladder frames in the folded position.

2. The folding scaffold device as in claim 1, wherein the fastening means for removably attaching the board shaped members to corresponding rungs of the first and second ladder frames when the scaffold is in the folded position comprises threaded studs protruding from the rungs of the first and second ladder frames through aligned holes in the board shaped members and held in place with securing means.

3. The folding scaffold device as in claim 1 wherein the third retaining means comprises a spring-like clip resiliently urged around the front vertical posts of the first and second ladder frames in the folded position.

* * * * *